US008525748B2

(12) United States Patent
Noguchi et al.

(10) Patent No.: US 8,525,748 B2
(45) Date of Patent: Sep. 3, 2013

(54) VARIABLE DIRECTIVITY ANTENNA APPARATUS PROVIDED WITH ANTENNA ELEMENTS AND AT LEAST ONE PARASITIC ELEMENT CONNECTED TO GROUND VIA CONTROLLED SWITCH

(75) Inventors: Wataru Noguchi, Hyogo (JP); Hiroyuki Yurugi, Osaka (JP); Masahiko Nagoshi, Osaka (JP); Sotaro Shinkai, Osaka (JP); Akihiko Shiotsuki, Osaka (JP)

(73) Assignee: Panasonic Corporation, Osaka (JP)

( * ) Notice: Subject to any disclaimer, the term of this patent is extended or adjusted under 35 U.S.C. 154(b) by 339 days.

(21) Appl. No.: 13/002,570

(22) PCT Filed: Jul. 8, 2009

(86) PCT No.: PCT/JP2009/003174

§ 371 (c)(1),
(2), (4) Date: Jan. 4, 2011

(87) PCT Pub. No.: WO2010/004739

PCT Pub. Date: Jan. 14, 2010

(65) Prior Publication Data

US 2011/0102287 A1 May 5, 2011

(30) Foreign Application Priority Data

Jul. 8, 2008 (JP) ..... 2008-177669

(51) Int. Cl.
*H01Q 19/00* (2006.01)

(52) U.S. Cl.
USPC ..... 343/833; 343/815; 343/834; 343/876

(58) Field of Classification Search
USPC ..... 343/700, 815, 817, 818, 833, 834, 343/876
See application file for complete search history.

(56) References Cited

U.S. PATENT DOCUMENTS 3,560,978 A * 2/1971 Himmel et al. ..... 342/399
5,235,343 A * 8/1993 Audren et al. ..... 343/816
5,243,358 A * 9/1993 Sanford et al. ..... 343/836

(Continued)

FOREIGN PATENT DOCUMENTS

EP 1 804 335 7/2007
JP 2002-261532 9/2002

(Continued)

OTHER PUBLICATIONS

International Preliminary Report on Patentability issued Mar. 10, 2011 in International (PCT) Application No. PCT/JP2009/003174.

(Continued)

*Primary Examiner* — Tho G Phan
(74) *Attorney, Agent, or Firm* — Wenderoth, Lind & Ponack, L.L.P.

(57) ABSTRACT

A variable directivity antenna apparatus is configured to include a parasitic element, a plurality of antenna elements each provided to be away from the parasitic element by an electrical length of a quarter-wavelength, and a PIN diode connected to the parasitic element and changing over whether or not to ground the parasitic element. A radiation pattern from the variable directivity antenna apparatus is changed by outputting a control signal for changing over whether or not the parasitic element operates as a parasitic element by selectively turning on or off the PIN diode.

6 Claims, 27 Drawing Sheets

(56) References Cited

U.S. PATENT DOCUMENTS

| | | | | |
|---|---|---|---|---|
| 6,034,638 | A * | 3/2000 | Thiel et al. | 343/702 |
| 7,242,366 | B2 | 7/2007 | Shibata | |
| 7,656,360 | B2 | 2/2010 | Hirabayashi | |
| 2007/0001924 | A1 | 1/2007 | Hirabayashi | |
| 2008/0088510 | A1 | 4/2008 | Murata et al. | |

FOREIGN PATENT DOCUMENTS

| | | |
|---|---|---|
| JP | 2003-258533 | 9/2003 |
| JP | 2003-258548 | 9/2003 |
| JP | 2007-13692 | 1/2007 |
| JP | 2007-325303 | 12/2007 |
| JP | 2008-85908 | 4/2008 |
| JP | 2008-153813 | 7/2008 |

OTHER PUBLICATIONS

International Search Report issued Oct. 27, 2009 in International (PCT) Application No. PCT/JP2009/003174.

* cited by examiner

| PARASITIC ELEMENT | 12a | 12b | 12c | 12d |
|---|---|---|---|---|
| SWITCHING STATE | OFF | OFF | OFF | OFF |

| PARASITIC ELEMENT | 12a | 12b | 12c | 12d |
|---|---|---|---|---|
| SWITCHING STATE | ON | OFF | OFF | OFF |

| PARASITIC ELEMENT | 12a | 12b | 12c | 12d |
|---|---|---|---|---|
| SWITCHING STATE | OFF | ON | OFF | OFF |

| PARASITIC ELEMENT | 12a | 12b | 12c | 12d |
|---|---|---|---|---|
| SWITCHING STATE | ON | ON | OFF | OFF |

| PARASITIC ELEMENT | 12a | 12b | 12c | 12d |
|---|---|---|---|---|
| SWITCHING STATE | OFF | OFF | ON | OFF |

| PARASITIC ELEMENT | 12a | 12b | 12c | 12d |
|---|---|---|---|---|
| SWITCHING STATE | ON | OFF | ON | OFF |

| PARASITIC ELEMENT | 12a | 12b | 12c | 12d |
|---|---|---|---|---|
| SWITCHING STATE | OFF | ON | ON | OFF |

| PARASITIC ELEMENT | 12a | 12b | 12c | 12d |
|---|---|---|---|---|
| SWITCHING STATE | ON | ON | ON | OFF |

| PARASITIC ELEMENT | 12a | 12b | 12c | 12d |
|---|---|---|---|---|
| SWITCHING STATE | OFF | OFF | OFF | ON |

| PARASITIC ELEMENT | 12a | 12b | 12c | 12d |
|---|---|---|---|---|
| SWITCHING STATE | ON | OFF | OFF | ON |

| PARASITIC ELEMENT | 12a | 12b | 12c | 12d |
|---|---|---|---|---|
| SWITCHING STATE | OFF | ON | OFF | ON |

| PARASITIC ELEMENT | 12a | 12b | 12c | 12d |
|---|---|---|---|---|
| SWITCHING STATE | ON | ON | OFF | ON |

| PARASITIC ELEMENT | 12a | 12b | 12c | 12d |
|---|---|---|---|---|
| SWITCHING STATE | OFF | OFF | ON | ON |

| PARASITIC ELEMENT | 12a | 12b | 12c | 12d |
|---|---|---|---|---|
| SWITCHING STATE | ON | OFF | ON | ON |

| PARASITIC ELEMENT | 12a | 12b | 12c | 12d |
|---|---|---|---|---|
| SWITCHING STATE | OFF | ON | ON | ON |

| PARASITIC ELEMENT | 12a | 12b | 12c | 12d |
|---|---|---|---|---|
| SWITCHING STATE | ON | ON | ON | ON |

VARIABLE DIRECTIVITY ANTENNA APPARATUS PROVIDED WITH ANTENNA ELEMENTS AND AT LEAST ONE PARASITIC ELEMENT CONNECTED TO GROUND VIA CONTROLLED SWITCH

TECHNICAL FIELD

The present invention relates to a variable directivity antenna apparatus for use in a wireless communication system employing, for example, a MIMO (Multiple Input Multiple Output) wireless method.

BACKGROUND ART

Up to now, various array antenna apparatuses have been proposed as variable directivity antenna apparatuses for use in a wireless communication system employing, for example, the MIMO wireless method (See Patent Documents 1 and 2, for example).

The Patent Document 1 discloses an array antenna apparatus, which has a structure simpler than that of an antenna according to prior art and can easily form an excitation element and parasitic elements. The array antenna apparatus is characterized as follows. At least one dielectric substrate on which at least one of a plurality of parasitic elements is provided around an excitation element. Alternatively, the array antenna apparatus includes the excitation element and a first dielectric substrate on which at least one of the plurality of parasitic elements is formed, and at least one second dielectric substrate is provided around the excitation element, where at least one further parasitic element among the plurality of parasitic element is formed on the second dielectric substrate.

In addition, the Patent Document 2 proposes an antenna apparatus which can control directivity or omni-directivity, radiation polarization, and a radiation direction of the antenna apparatus to provide a desired state without increasing size and cost of the antenna apparatus, by devising a structure of each antenna element. The antenna apparatus includes a conductive excitation element, parasitic elements each made of semiconductive plastics, and control electrodes connected to these parasitic elements, respectively, where the conductive excitation element and the parasitic elements have predetermined lengths and arranged on a dielectric substrate, respectively. Direct-current bias voltages supplied to the control electrodes are controlled to change over the parasitic elements to have insulating properties or conductive properties. The antenna apparatus is characterized as follows. Two parasitic elements changed over to have the conductive properties are combined to configure a directional antenna apparatus including a wave director, a reflector and the like. In addition, the wave director and the reflector other than this excitation element (feeder) are made to have the insulating properties to configure an omni-directional antenna apparatus.

CITATION LIST

Patent Document

Patent Document 1: Japanese patent laid-open publication No. JP-2002-261532-A.

Patent Document 2: Japanese patent laid-open publication No. JP-2007-013692-A.

SUMMARY OF INVENTION

Technical Problem

However, in all the environments, causes for unstable wireless communication are roughly classified into two problems.

The first problem is that an electric field level is low because of a too long distance between wireless apparatuses in a case of a predetermined outputted power of a radio wave. In regard of this problem, it is possible to receive the radio wave with a stable electric field level by configuring at least one of antenna elements of a base station and a terminal to have directivity and by orienting the directivity to the antenna element of the other party.

The second problem is that fading occurs in a band required for communication due to interference of reflected waves from walls and a ceiling. In this case, the problem becomes a severe one at a location where a level difference between a direct radio wave and the reflected wave is very small. Therefore, in a manner similar to that of the first problem, the interference can be suppressed by configuring an antenna element to have directivity so as not to receive radio waves other than a desired wave. This method is effective when SISO (Single Input Single Output) is employed and antenna selection diversity for changing over antenna elements of a receiver side is adopted. However, this method causes a problem when the receiver side executes MRC (Maximum Ratio Combination) processing instead of simply adopting the antenna selection diversity. For example, in a case of an OFDM (Orthogonal Frequency Division Multiplex) wireless communication system typified by IEEE802.11a/g Standards, when one of two antenna elements each having directivity receives a direct wave and another antenna element receives a reflected wave having a delay time longer than an assumed time of a guard interval of the direct wave, a signal deteriorates in a desired band.

In this case, the MIMO wireless communication method typified by IEEE802.11n Standards is provided for increasing a communication rate greatly by receiving a radio wave via a plurality of antennas and decomposing the radio wave into a plurality of streams according to propagation channels generated from path differences among the antennas. Namely, the MIMO wireless communication method positively uses propagation path differences among antenna elements. Generally speaking, a wireless apparatus employing this MIMO wireless communication method uses a plurality of omni-directional antennas such as dipole antennas or sleeve antennas. In this case, when the antennas are not away from each other by one wavelength or longer, correlation among the antennas becomes large, it is not possible to generate propagation channels enough to ensure a transmission quality. In addition, there has been known a method of reducing this antenna correlation by tilting respective antenna elements in directions different from each other to provide a combination of different polarized waves. However, this method has such a mounting problem that it is required to tilt the antenna elements physically.

In any case, there is such a problem that an antenna apparatus of a wireless apparatus employing the MIMO wireless method cannot be generally made small in size at present.

It is an object of the present invention to provide a variable directivity antenna apparatus capable of solving the above described problems, and capable of reducing the size thereof and improving a transmission quality of MIMO wireless method by making it possible to shorten the inter-element distance greatly, in the environment in which the fading tends to occur because of many reflected waves.

SOLUTION TO PROBLEM

A variable directivity antenna apparatus according to the present invention includes a first parasitic element, a plurality of antenna elements each provided in proximity to the first parasitic element so as to be electromagnetically coupled to the first parasitic element, first switch means connected to the first parasitic element, and changing over whether or not to ground the first parasitic element, and controller means. The controller means changes a radiation pattern from the variable directivity antenna apparatus by outputting a control signal for turning on or off the first switch means to change over whether or not the first parasitic element operates as a reflector.

The above-mentioned variable directivity antenna apparatus includes two antenna elements.

In addition, the above-mentioned variable directivity antenna apparatus further includes at least one second parasitic element each provided in proximity to the respective antenna elements so as to be electromagnetically coupled to the respective antenna elements, and at least one second switch means connected to the at least one second parasitic element, and changing over whether or not to ground each of the second parasitic elements. The controller means outputs a further control signal for selectively turning on or off each of the switch means to selectively change over whether or not each of the parasitic elements operates as a reflector.

Further, the above-mentioned variable directivity antenna apparatus includes two antenna elements and one second parasitic element.

Still further, the above-mentioned variable directivity antenna apparatus includes two antenna elements and four second parasitic elements.

In addition, the above-mentioned variable directivity antenna apparatus includes three antenna elements and three second parasitic elements.

Further, the above-mentioned variable directivity antenna apparatus includes four antenna elements and four second parasitic elements.

Still further, in the above-mentioned variable directivity antenna apparatus, each of the antenna elements is provided to be away from the first parasitic element by an electrical length of a quarter-wavelength.

In addition, in the above-mentioned variable directivity antenna apparatus, each of the antenna elements is provided to be away from the first parasitic element by an electrical length of a quarter-wavelength, and each of the second parasitic elements is provided to be away from each of the antenna elements by an electrical length of a quarter-wavelength.

Further, in the above-mentioned variable directivity antenna apparatus, each of the switch means is a PIN diode connected between each of the parasitic element and a ground conductor.

ADVANTAGEOUS EFFECTS OF INVENTION

Therefore, in the variable directivity antenna apparatus according to the present invention, the distance between each antenna element and each parasitic element is set so that the antenna element is electromagnetically coupled to the parasitic element. The variable directivity antenna apparatus includes the controller means for changing a radiation pattern from the variable directivity antenna apparatus by outputting a control signal for turning on or off the first switch means to change over whether or not the first parasitic element operates as a parasitic element. Therefore, it is possible to selectively change radiation pattern from the variable directivity antenna apparatus, and orient a main beam of the radiation pattern to a desired direction. Due to this configuration, it is possible to greatly shorten the inter-element distance in the environment in which the fading tends to occur because of many reflected waves, and this leads to the variable directivity antenna apparatus which has a small size and can improve a transmission quality of the MIMO wireless method.

Figure 1A:
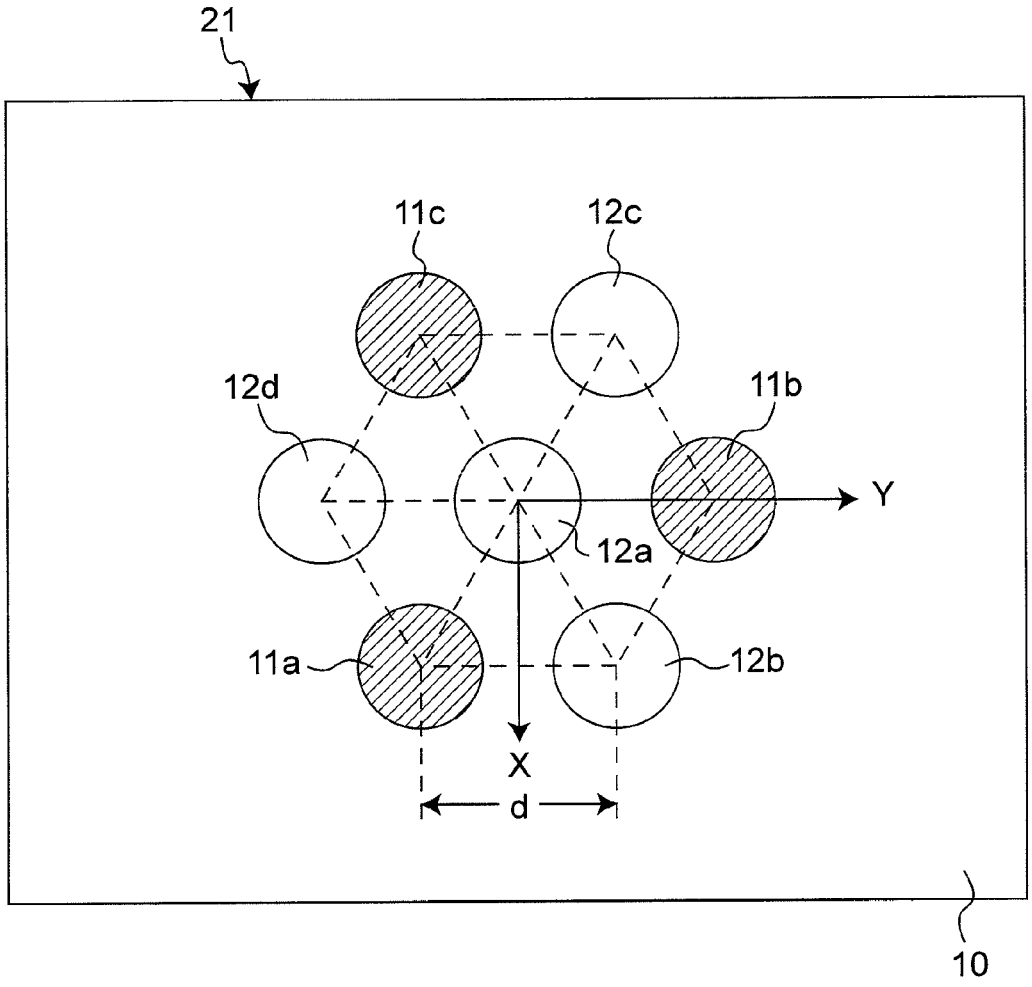
FIG. 1A is a plan view showing a configuration of a variable directivity antenna apparatus 21 according to a first preferred embodiment of the present invention.
Figure 1B:
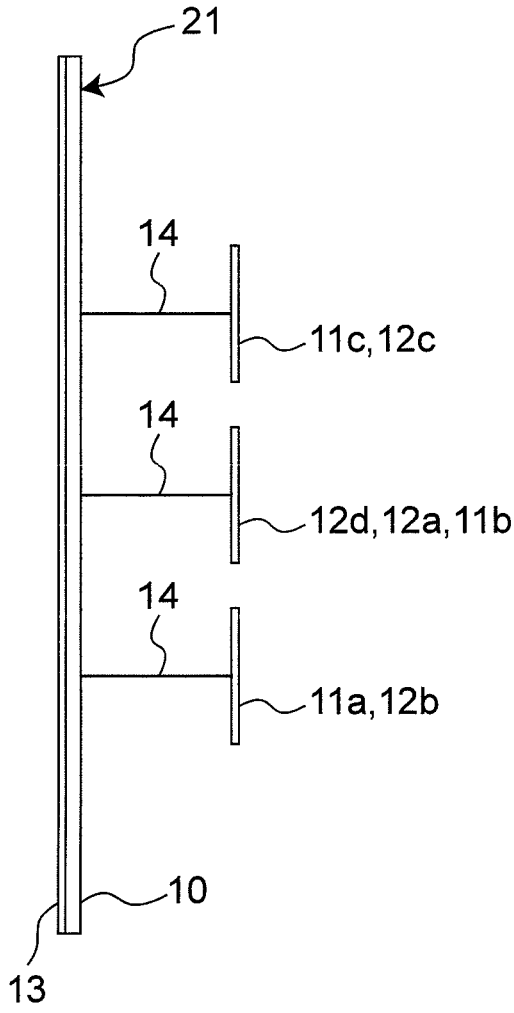
FIG. 1B is a side view of the variable directivity antenna apparatus 21 of FIG. 1A.
Figure 12:
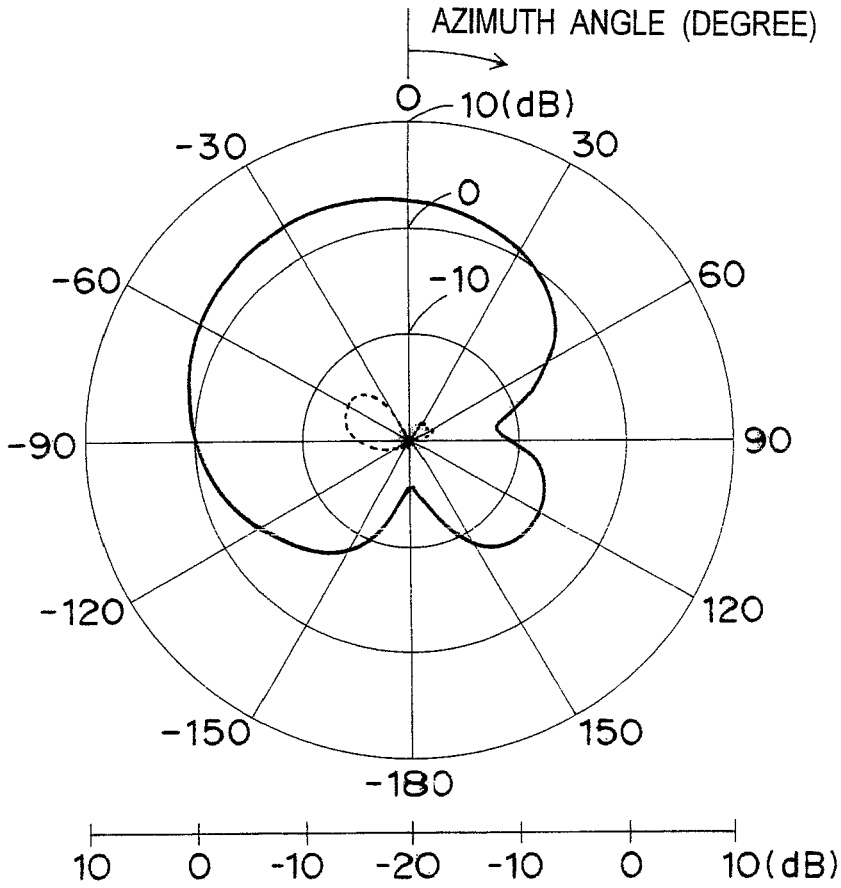
Figure 13:
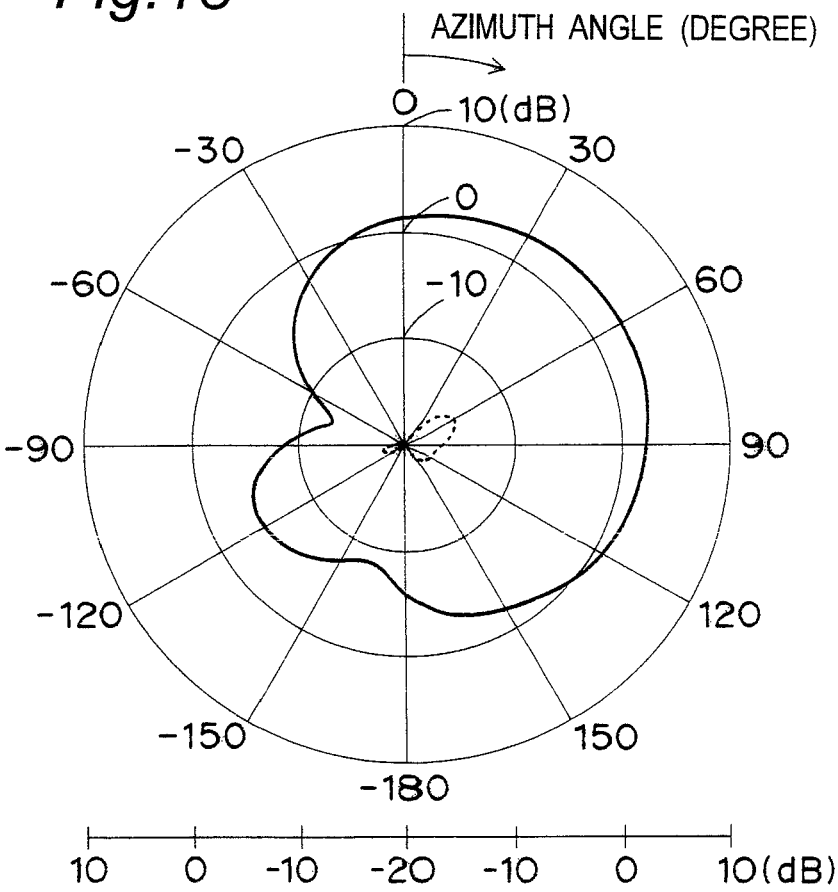
Figure 14:
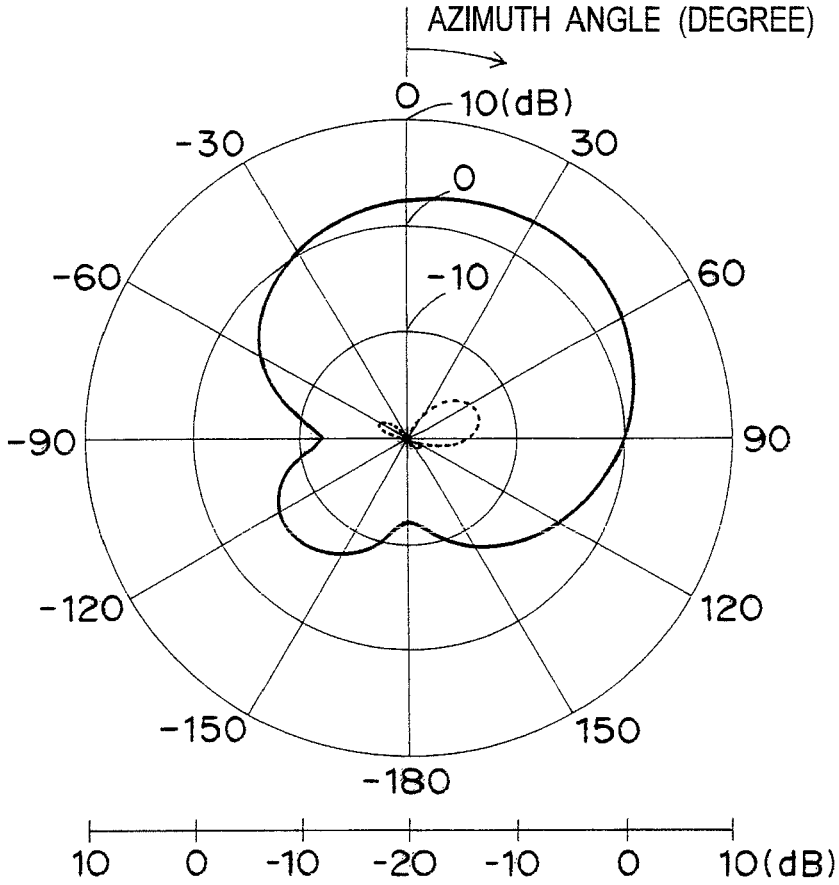
Figure 15:
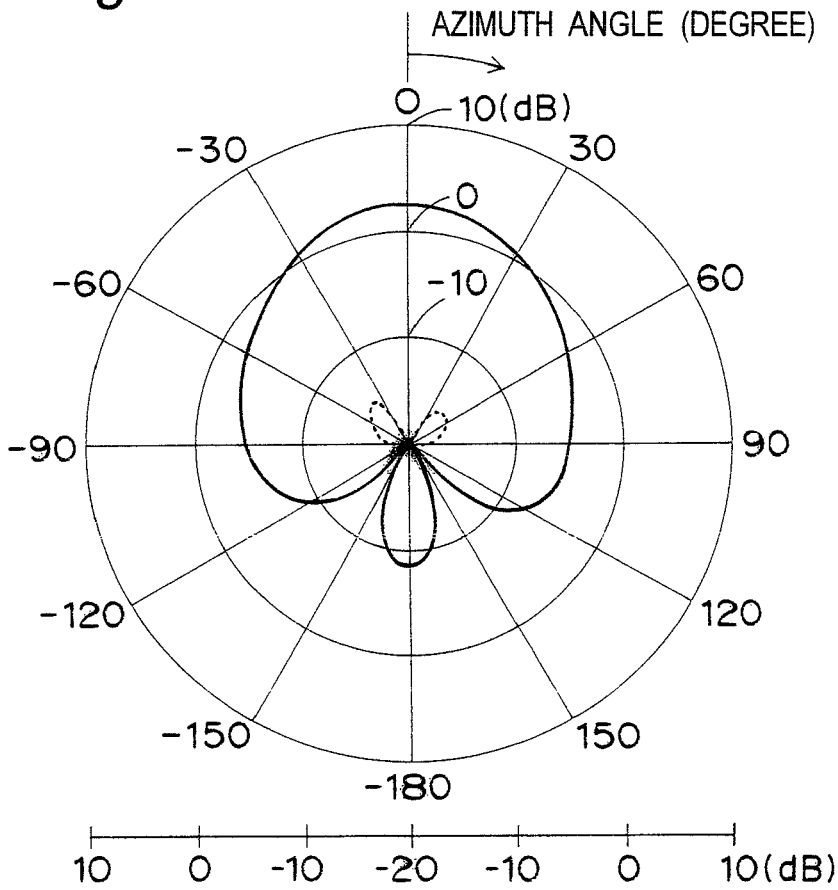
Figure 16:
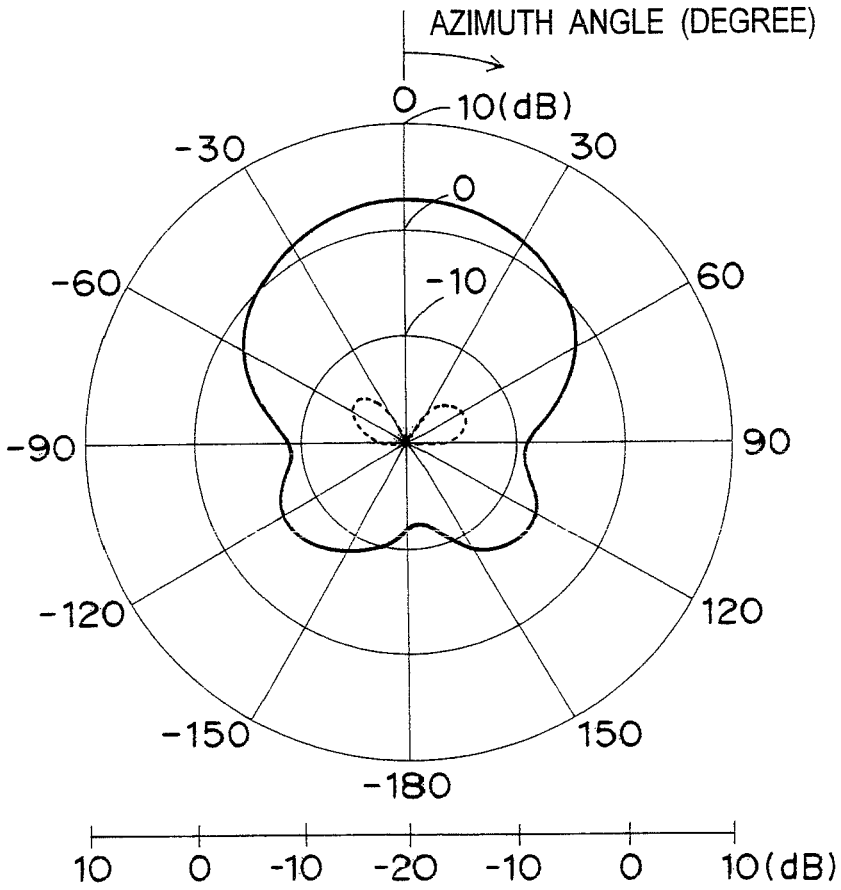
Figure 17:
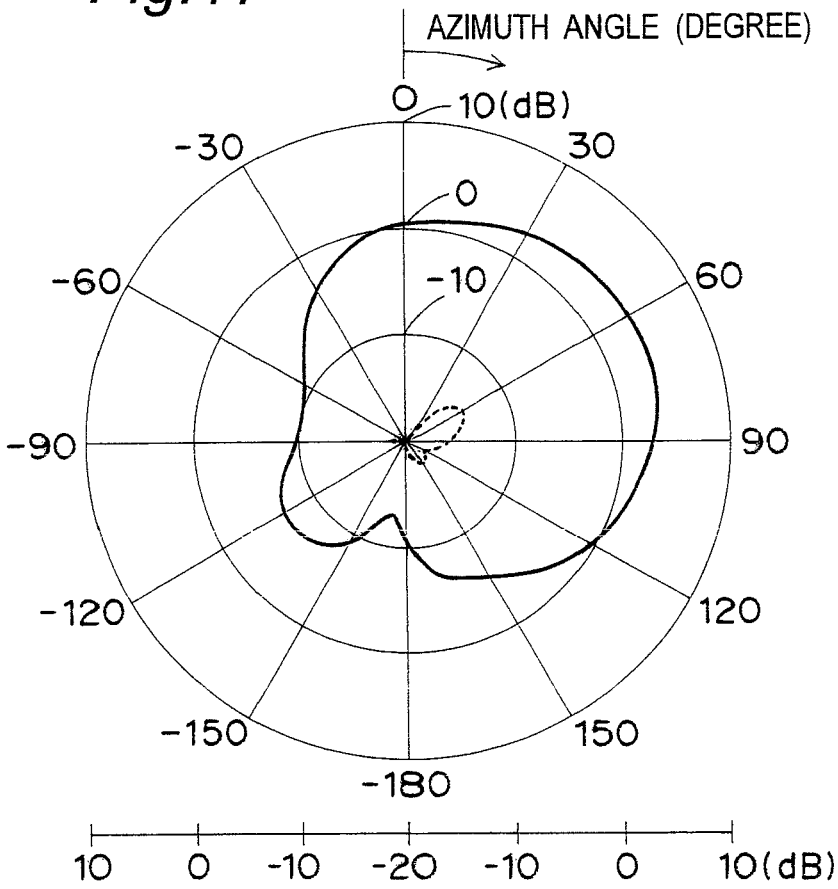
Figure 18:
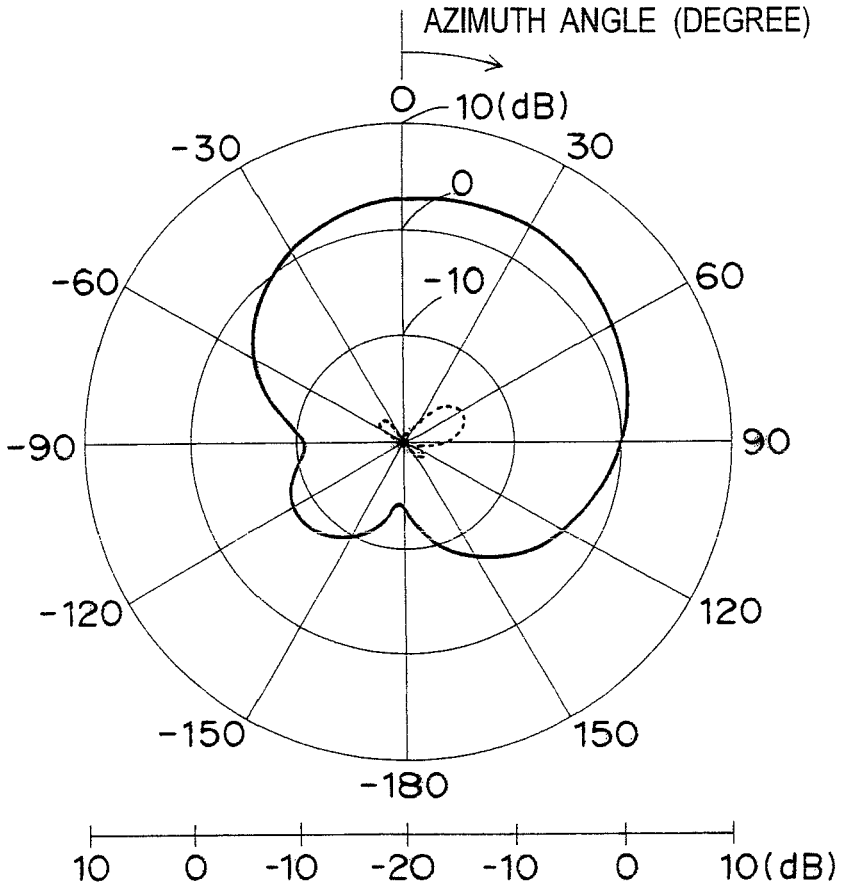
Figure 19:
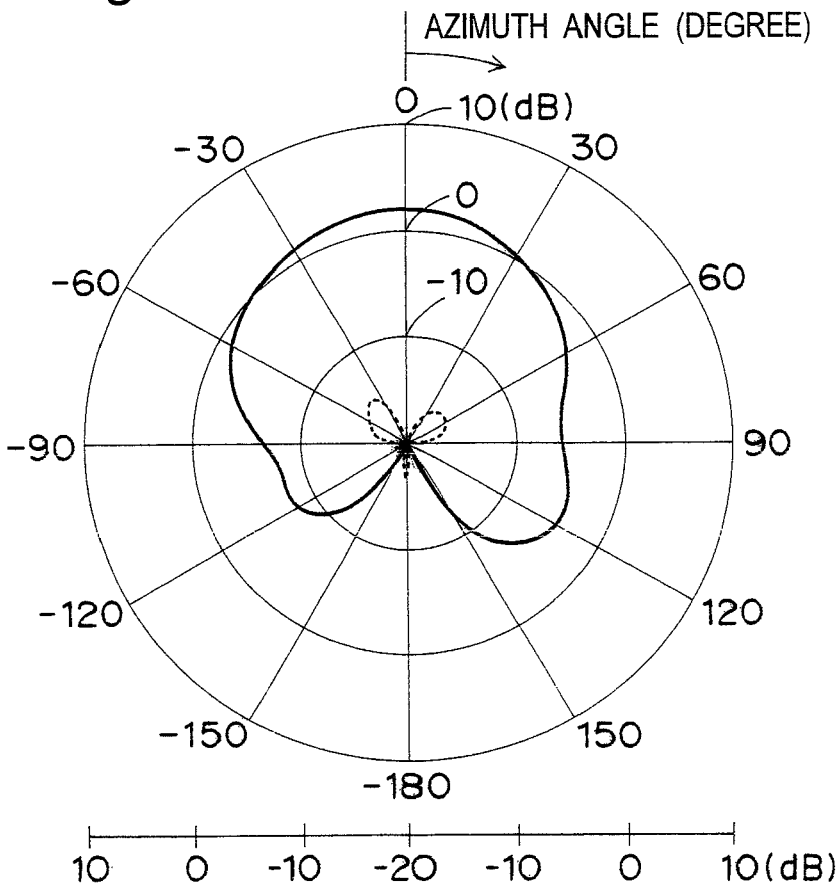
Figure 20:
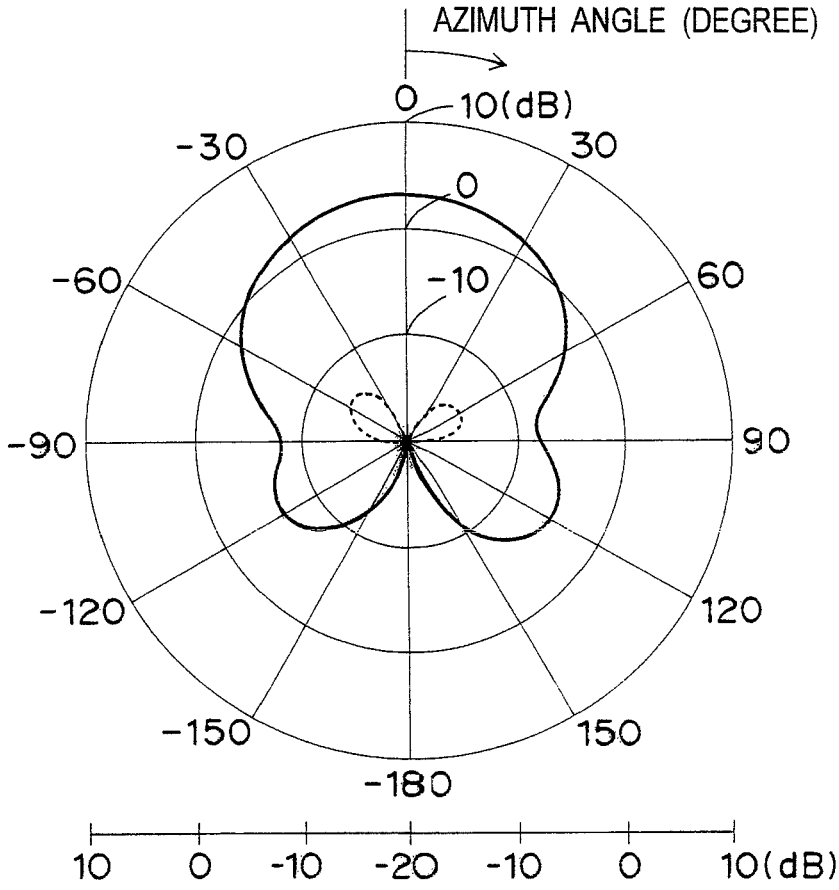
Figure 21:
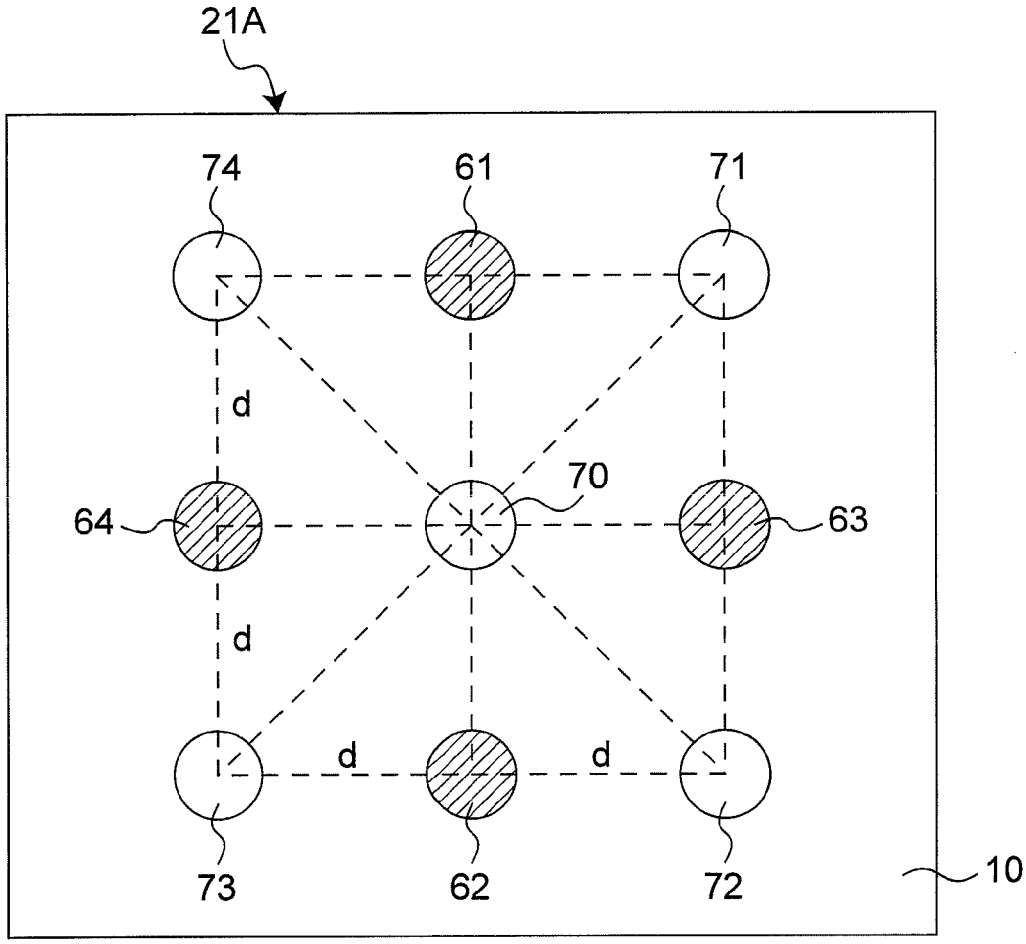
Figure 22:
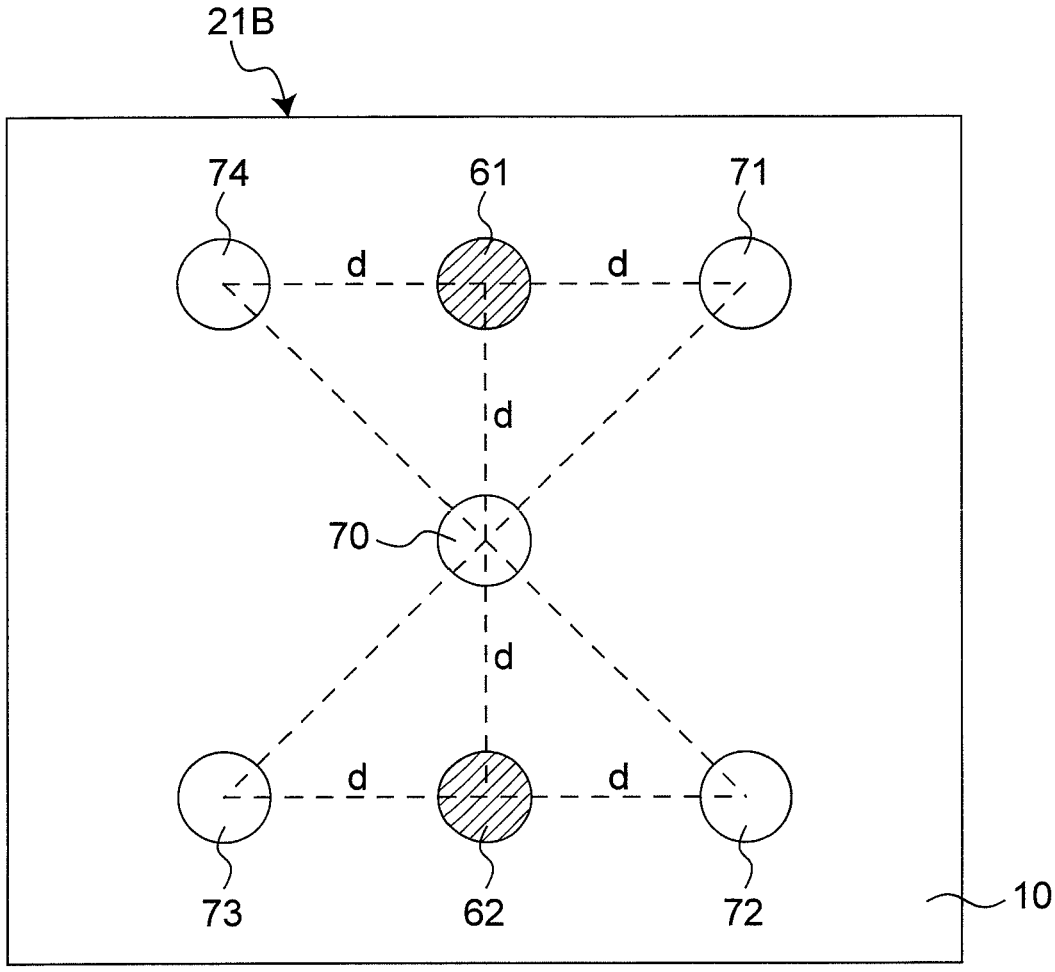
Figure 23A:
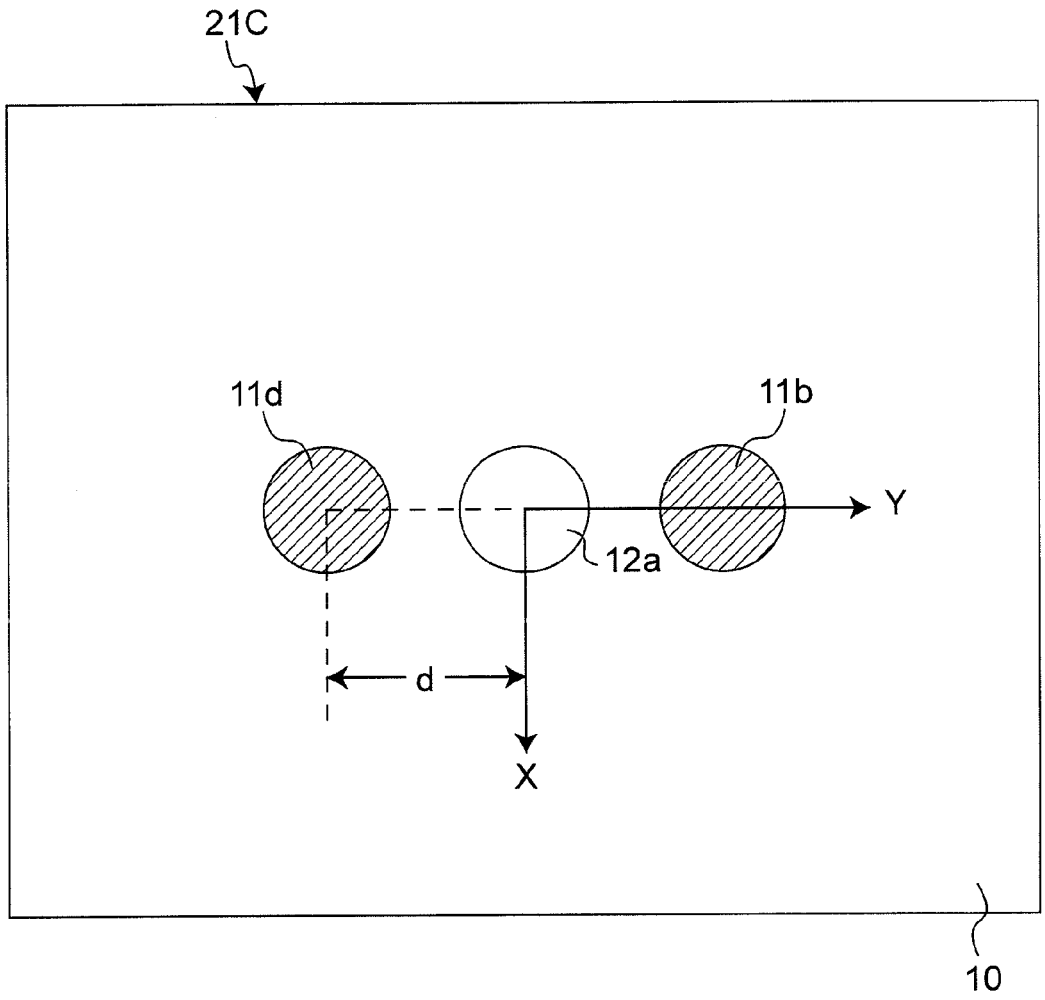
Figure 23B:
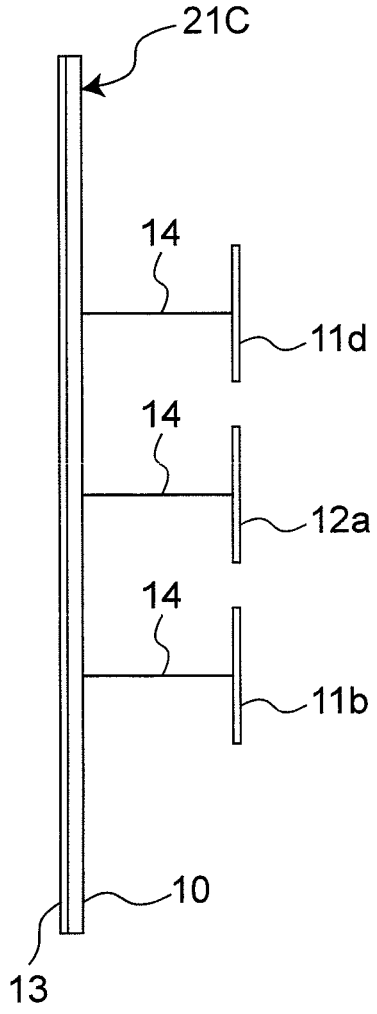
Figure 24A:
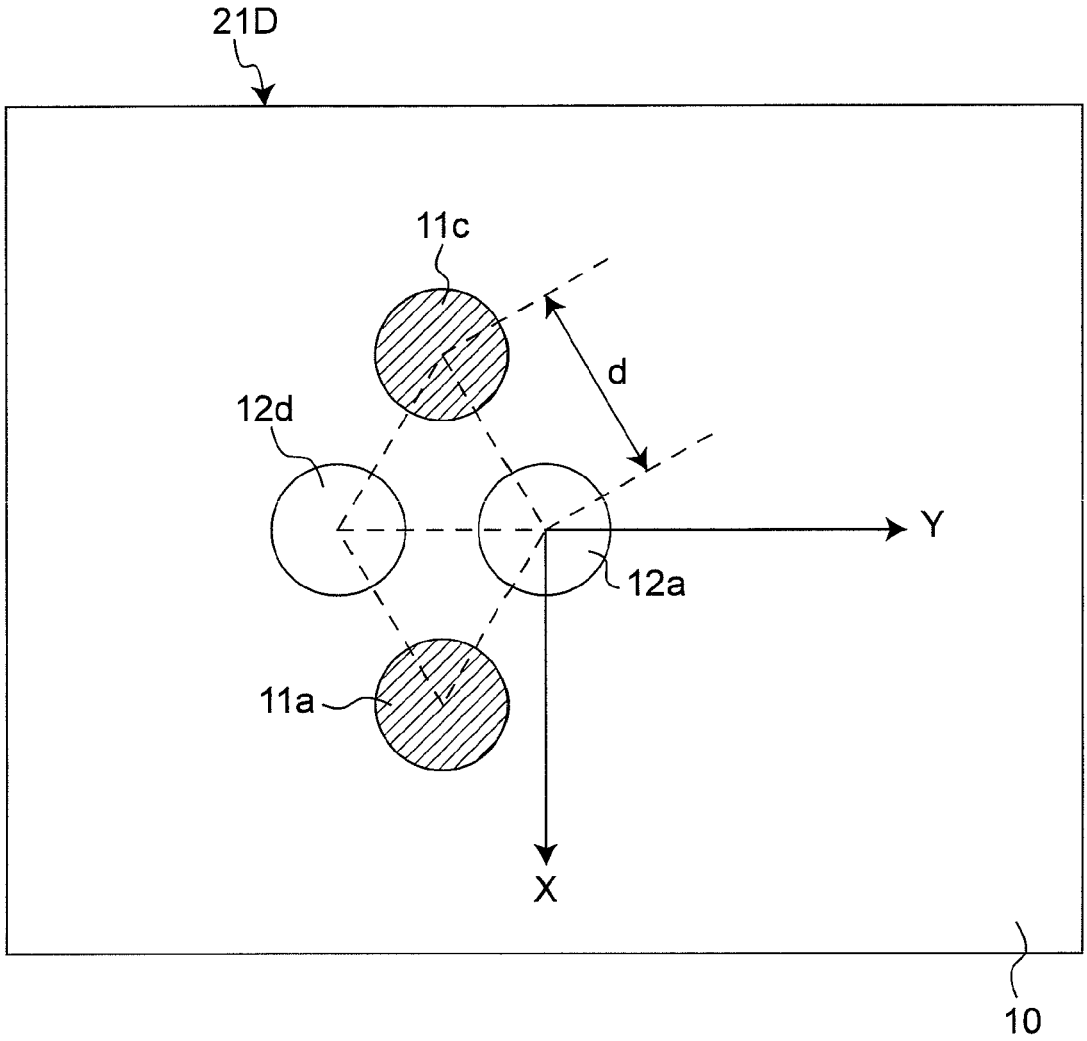
Figure 24B:
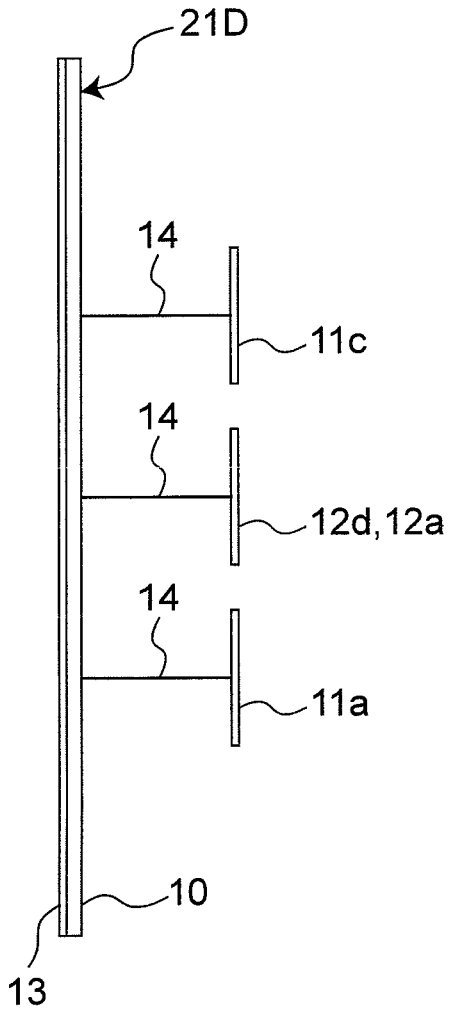

FIG. 12 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned on, the parasitic element 12*c* is turned off, and the parasitic element 12*d* is turned off;

FIG. 13 is a diagram of radiation pattern characteristics in the XY plane, showing simulation results of the variable directivity antenna apparatus 21 of FIGS. 1A and 1B when the parasitic element 12*a* is turned off, the parasitic element 12*b* is turned off, the parasitic element 12*c* is turned off, and the parasitic element 12*d* is turned on;

FIG. 14 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned off, the parasitic element 12*c* is turned off, and the parasitic element 12*d* is turned on;

FIG. 15 is a diagram of radiation pattern characteristics in the XY plane, showing simulation results of the variable directivity antenna apparatus 21 of FIGS. 1A and 1B when the parasitic element 12*a* is turned off, the parasitic element 12*b* is turned on, the parasitic element 12*c* is turned off, and the parasitic element 12*d* is turned on;

FIG. 16 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned on, the parasitic element 12*c* is turned off, and the parasitic element 12*d* is turned on;

FIG. 17 is a diagram of radiation pattern characteristics in the XY plane, showing simulation results of the variable directivity antenna apparatus 21 of FIGS. 1A and 1B when the parasitic element 12*a* is turned off, the parasitic element 12*b* is turned off, the parasitic element 12*c* is turned on, and the parasitic element 12*d* is turned on;

FIG. 18 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned off, the parasitic element 12*c* is turned on, and the parasitic element 12*d* is turned on;

FIG. 19 is a diagram of radiation pattern characteristics in the XY plane, showing simulation results of the variable directivity antenna apparatus 21 of FIGS. 1A and 1B when the parasitic element 12*a* is turned off, the parasitic element 12*b* is turned on, the parasitic element 12*c* is turned on, and the parasitic element 12*d* is turned on;

FIG. 20 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned on, the parasitic element 12*c* is turned on, and the parasitic element 12*d* is turned on;

FIG. 21 is a plan view showing a configuration of a variable directivity antenna apparatus 21A according to a second preferred embodiment of the present invention;

FIG. 22 is a plan view showing a configuration of a variable directivity antenna apparatus 21B according to a third preferred embodiment of the present invention;

FIG. 23A is a plan view showing a configuration of a variable directivity antenna apparatus 21C according to a fourth preferred embodiment of the present invention;

FIG. 23B is a side view of the variable directivity antenna apparatus 21C of FIG. 23A;

FIG. 24A is a plan view showing a configuration of a variable directivity antenna apparatus 21D according to a fifth embodiment of the present invention; and FIG. 24B is a side view of the variable directivity antenna apparatus 21D of FIG. 24A.

DESCRIPTION OF EMBODIMENTS

Preferred embodiments according to the present invention will be described below with reference to the attached drawings. Components similar to each other are denoted by the same reference numerals and will not be described herein in detail.

First Preferred Embodiment

Figure 2:
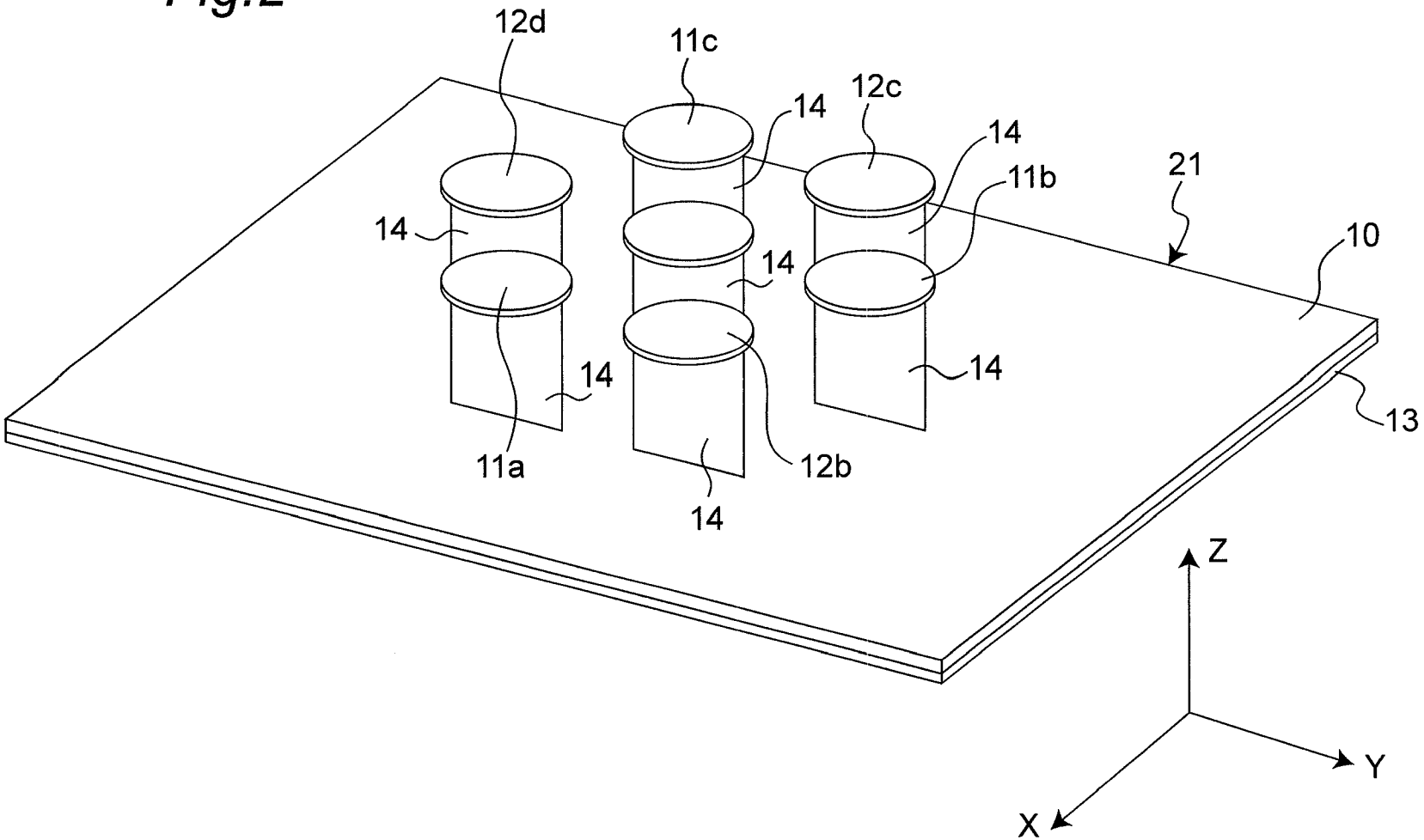
FIG. 2 is a perspective view of the variable directivity antenna apparatus 21 of FIGS. 1A and 1B.

FIG. 1A is a plan view showing a configuration of a variable directivity antenna apparatus 21 according to a first preferred embodiment of the present invention. FIG. 1B is a side view of the variable directivity antenna apparatus 21. FIG. 2 is a perspective view of the variable directivity antenna apparatus 21 of FIGS. 1A and 1B.

In the variable directivity antenna apparatus according to the present preferred embodiment, a parasitic element 12*a*, an antenna element 11*a*, a parasitic element 12*d*, an antenna element 11*c*, a parasitic element 12*c*, an antenna element 11*b*, and a parasitic element 12*b* are provided on a dielectric substrate 10 having a back surface on which a ground conductor 13 is formed. The antenna element 11*a*, the parasitic element 12*d*, the antenna element 11*c*, the parasitic element 12*c*, the antenna element 11*b*, and the parasitic element 12*b* are arranged on a circumference of a circle in a clockwise order so as to be located at vertexes of a regular hexagon, respectively, where the circle has a radius of "d" and a center at which a parasitic element 12*a* is located. Each of the elements 11*a* to 11*c* and 12*a* to 12*d* has a circular patch antenna having a predetermined circumferential length and provided at a top portion thereof, and is supported by a support member 14 that has a feeding line and the like to the dielectric substrate 10 therein. It is to be noted that each of the elements 11*a* to 11*c* and 12*a* to 11*d* may be, for example, a quarter-wavelength whip antenna. In this case, an inter-element spacing "d" is set to 14 mm, which corresponds to an electrical length of about a quarter-wavelength ($\lambda/4$) for an operating frequency of 5.2 GHz so that the antenna element and the parasitic element adjacent to each other are electromagnetically coupled to each other. When communication is to be held in a 2.4 GHz band, it suffices to set the spacing to an electrical length of about 31 mm. As will be described later in detail, in the variable directivity antenna apparatus 21 configured as described above, it is possible to form a total of 16 ($=2^4$) directional patterns by turning on or off control signals for the four parasitic elements 12*a* to 12*d*, respectively.

Figure 3:
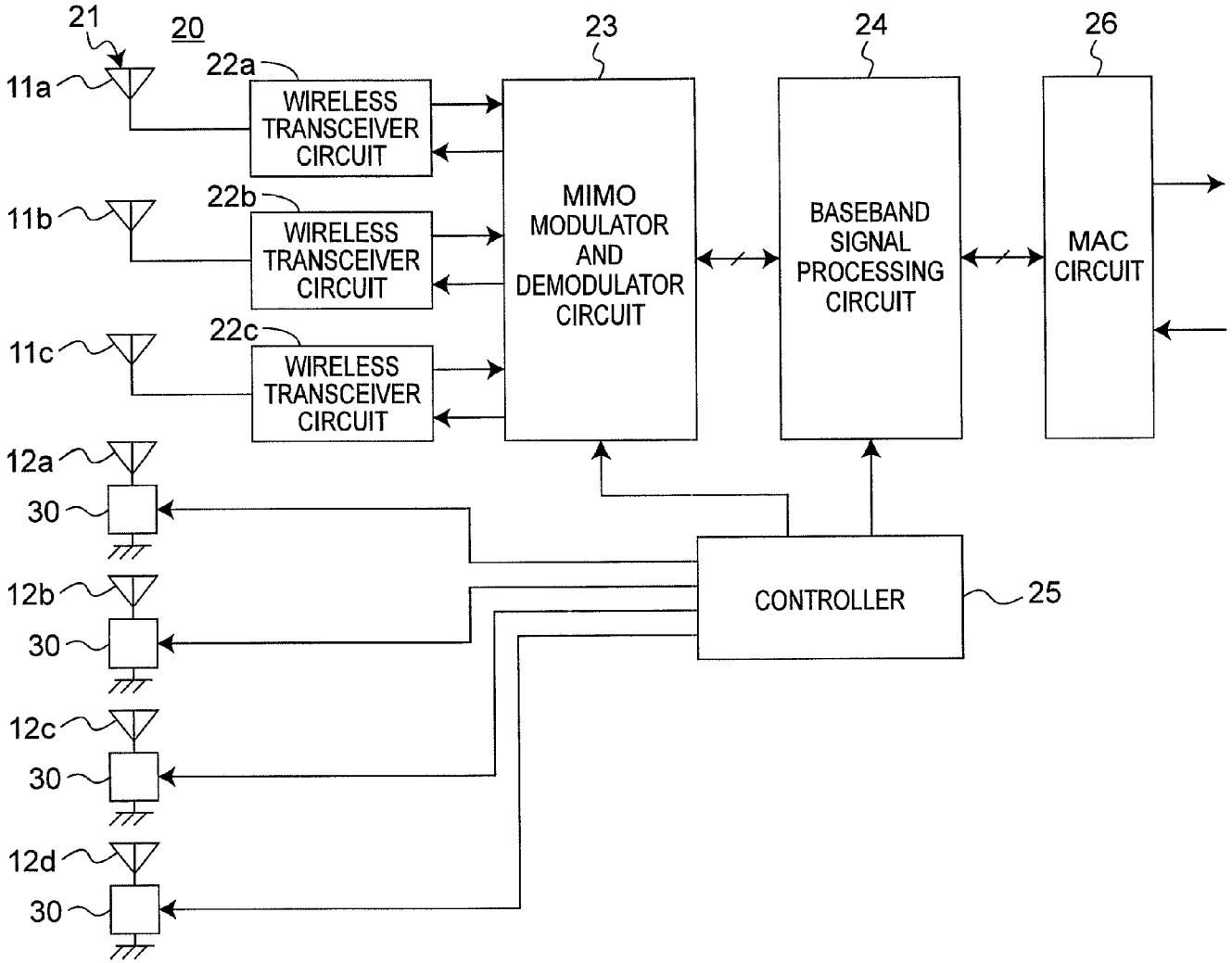
FIG. 3 is a block diagram showing a configuration of a wireless communication apparatus 20 using the variable directivity antenna apparatus 21 of FIGS. 1A and 1B.
Figure 4:
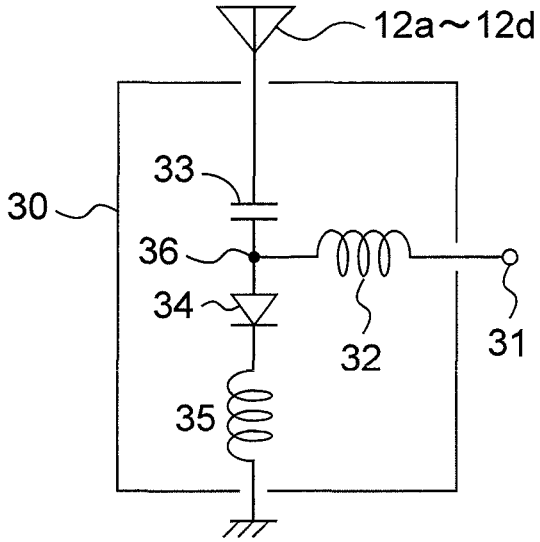
FIG. 4 is a circuit diagram showing a configuration of a control circuit 30 for each of parasitic elements 12*a* to 12*d* of FIGS. 1A and 1B.
Figure 5:
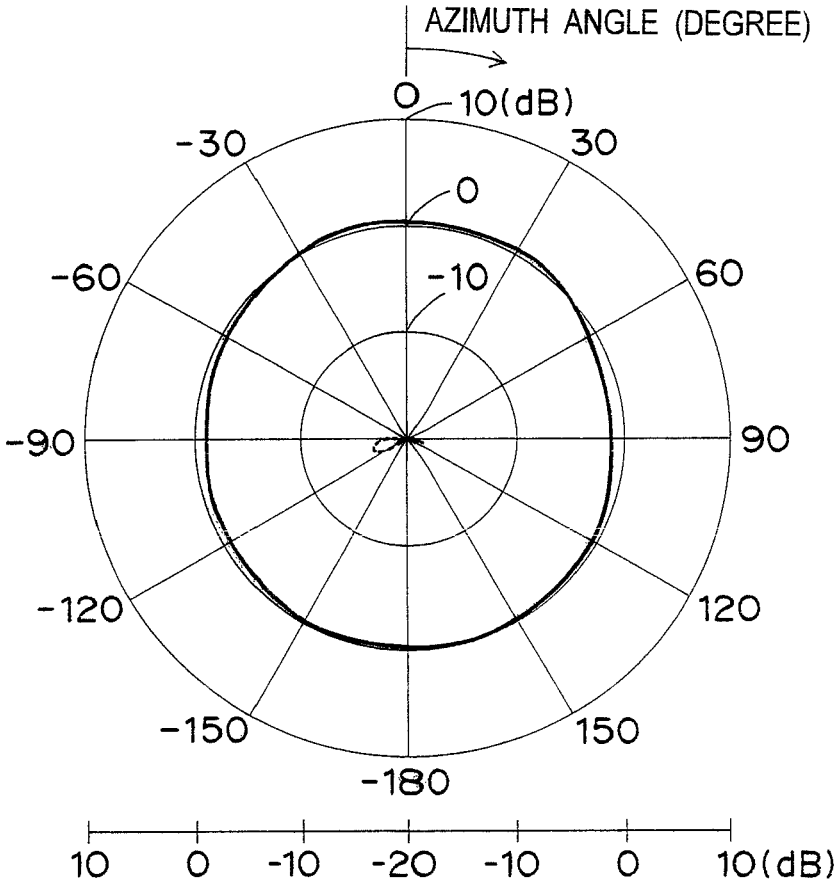
FIG. 5 is a diagram of radiation pattern characteristics in an XY plane, showing simulation results of the variable directivity antenna apparatus 21 of FIGS. 1A and 1B when the parasitic element 12*a* is turned off, the parasitic element 12*b* is turned off, the parasitic element 12*c* is turned off, and the parasitic element 12*d* is turned off.
Figure 6:
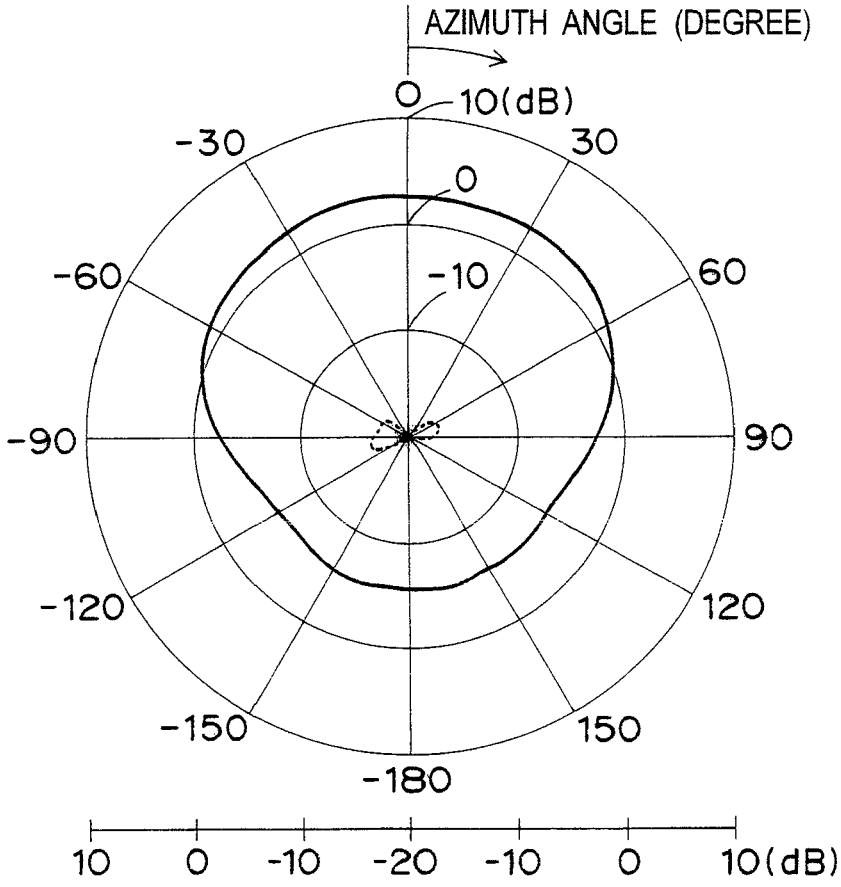
FIG. 6 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned off, the parasitic element 12*c* is turned off, and the parasitic element 12*d* is turned off.
Figure 7:
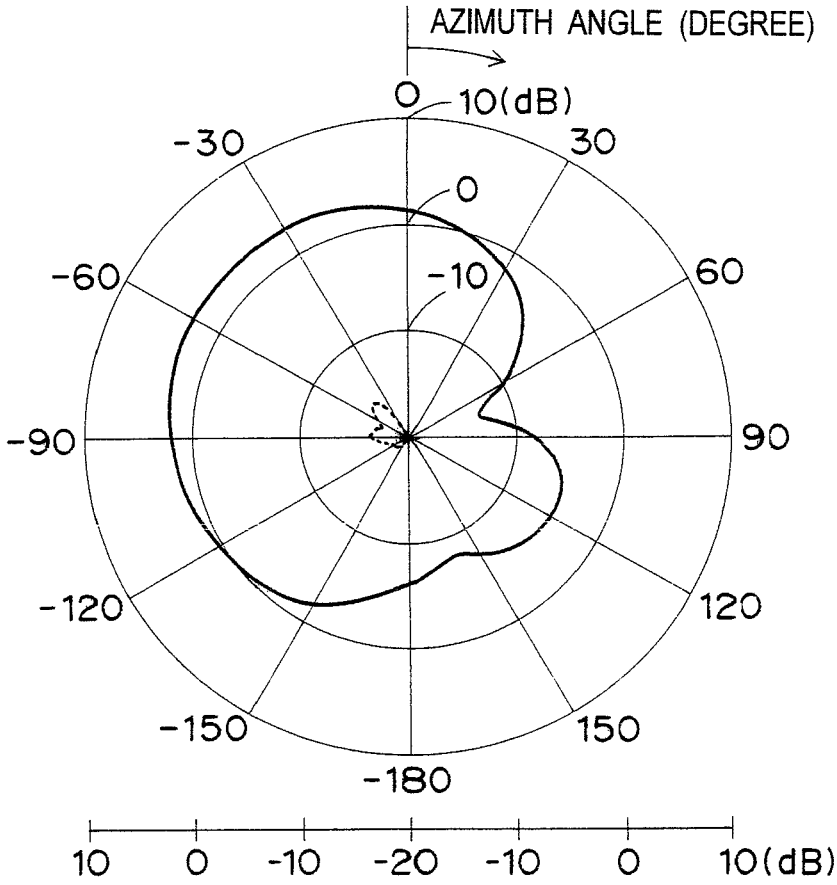
FIG. 7 is a diagram of radiation pattern characteristics in the XY plane, showing simulation results of the variable directivity antenna apparatus 21 of FIGS. 1A and 1B when the parasitic element 12*a* is turned off, the parasitic element 12*b* is turned on, the parasitic element 12*c* is turned off, and the parasitic element 12*d* is turned off.
Figure 8:
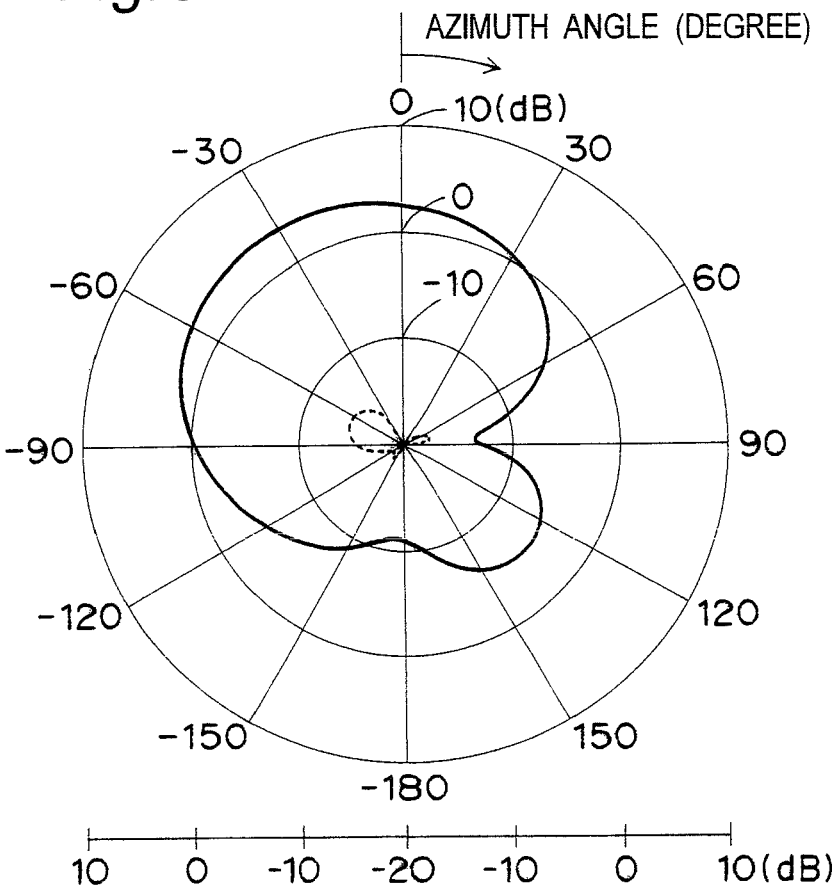
FIG. 8 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned on, the parasitic element 12*c* is turned off, and the parasitic element 12*d* is turned off.
Figure 9:
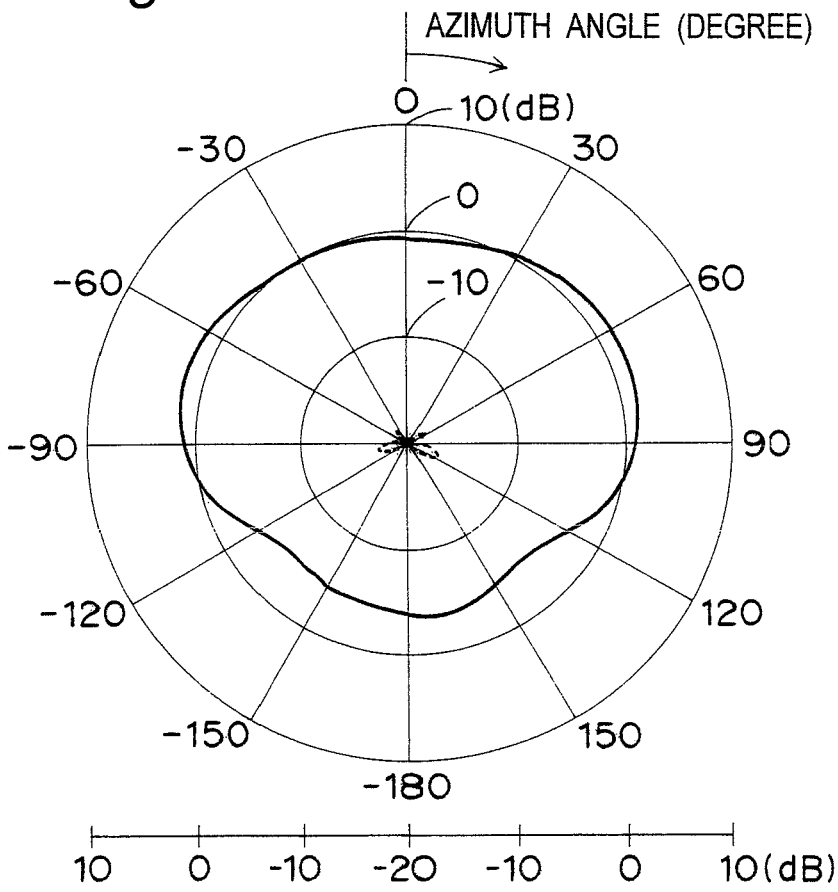
FIG. 9 is a diagram of radiation pattern characteristics in the XY plane, showing simulation results of the variable directivity antenna apparatus 21 of FIGS. 1A and 1B when the parasitic element 12*a* is turned off, the parasitic element 12*b* is turned off, the parasitic element 12*c* is turned on, and the parasitic element 12*d* is turned off.
Figure 10:
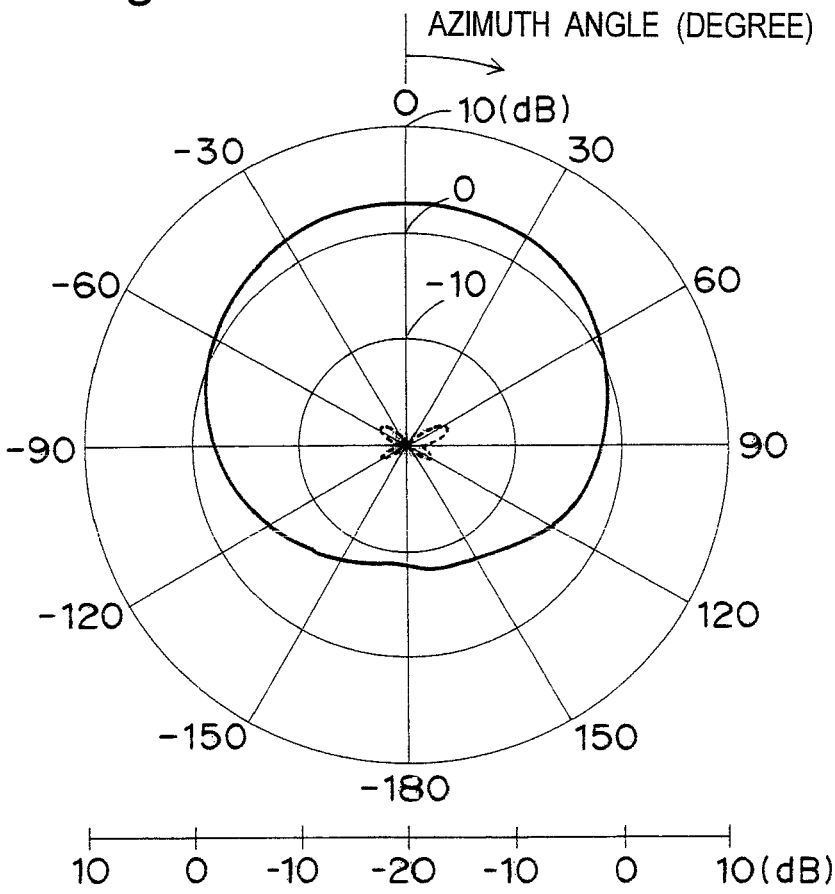
FIG. 10 is a diagram of radiation pattern characteristics in the XY plane, showing simulation results of the variable directivity antenna apparatus 21 of FIGS. 1A and 1B when the parasitic element 12*a* is turned on, the parasitic element 12*b* is turned off, the parasitic element 12*c* is turned on, and the parasitic element 12*d* is turned off.
Figure 11:
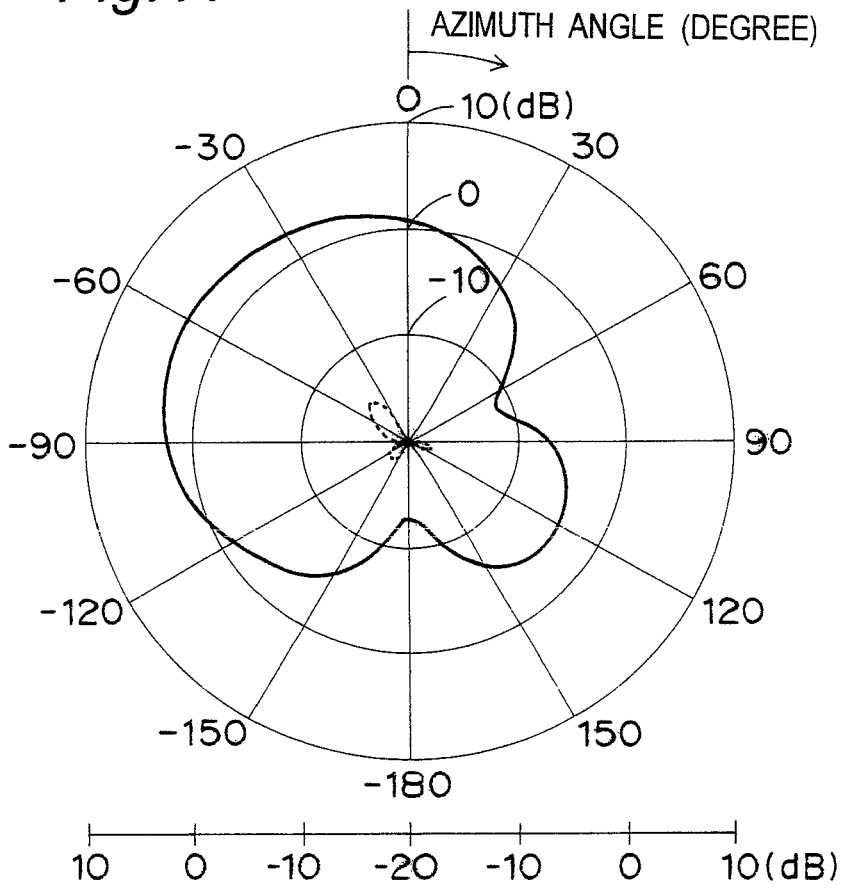
FIG. 11 is a diagram of radiation pattern characteristics in the XY plane, showing simulation results of the variable directivity antenna apparatus 21 of FIGS. 1A and 1B when the parasitic element 12*a* is turned off, the parasitic element 12*b* is turned on, the parasitic element 12*c* is turned on, and the parasitic element 12*d* is turned off.

FIG. 3 is a block diagram showing a configuration of a wireless communication apparatus 20 using the variable directivity antenna apparatus 21 of FIGS. 1A and 1B. FIG. 4 is a circuit diagram showing a configuration of a control circuit 30 for each of the parasitic elements 12*a* to 12*d* of FIGS. 1A and 1B. Referring to FIG. 3, the wireless communication apparatus according to the present preferred embodiment is configured by including the variable directivity antenna apparatus 21 of FIGS. 1A, 1B and 2, three wireless transceiver circuits 22*a*, 22*b*, and 22*c*, a MIMO modulator and demodulator circuit 23, a baseband signal processing circuit 24, a MAC (Media Access Control) circuit 26, and a controller 25 for controlling the variable directivity antenna apparatus 21 and these circuits. In this case, each of the wireless transceiver circuits 22*a*, 22*b*, and 22*c* is configured by including a duplexer, a wireless transmitter circuit, and a wireless receiver circuit. Using a well-known MIMO modulation and demodulation method, the MIMO modulator and demodulator circuit 23 executes a modulation processing on wireless signals transmitted by the three antenna elements 11*a* to 11*c* and the wireless transceiver circuits 22*a* to 22*c*, and executes a demodulation processing on wireless signals received by the three antenna elements 11*a* to 11*c* and the wireless transceiver circuits 22*a* to 22*c*. The baseband signal processing circuit 24 is connected to the MIMO modulator and demodulator circuit 23 and the MAC circuit 26, executes a predetermined baseband signal processing on a data signal inputted from the MAC circuit 26, and outputs a processed data signal to the MIMO modulator and demodulator circuit 23. The baseband signal processing circuit 24 also executes a predetermined baseband signal processing on a demodulated signal from the MIMO modulator and demodulator circuit 23, and outputs a processed demodulated signal to the MAC circuit 26. The MAC circuit 26 generates a predetermined data signal by executing a predetermined signal processing for the MAC, and outputs a generated predetermined data signal to the baseband signal processing circuit 24. The MAC circuit 26 inputs the data signal from the baseband signal processing circuit 24, and executes a predetermined MAC processing on the data signal.

In the variable directivity antenna apparatus 21, the antenna elements 11*a*, 11*b*, and 11*c* are connected to the wireless transceiver circuits 22*a*, 22*b*, and 22*c*, respectively. Each of the parasitic elements 12*a*, 12*b*, 12*c*, and 12*d* has the control circuit 30 of FIG. 4. Control signals for the parasitic elements 12*a*, 12*b*, 12*c*, and 12*d* are supplied to the respective control circuits 30 from the controller 25. Referring to FIG. 4, each of the parasitic elements 12*a*, 12*b*, 12*c*, and 12*d* is connected to a connection point 36 via an impedance matching capacitor 33. The connection point 36 is connected to a control signal input terminal 31 via a high frequency blocking inductor 32 having impedance high enough at the operating frequency, and an anode of a PIN diode 34. A cathode of the PIN diode 34 is grounded via an inductor 35 for changing an electrical length of the parasitic element. By inputting a control signal having a predetermined positive direct-current voltage to the control signal input terminal 31, the PIN diode 34 is turned on, and each of the parasitic elements 12*a*, 12*b*, 12*c*, and 12*d* operates as a parasitic element (reflector) having an electrical length longer than those of the antenna elements 11*a*, 11*b*, and 11*c*. On the other hand, by inputting a control signal representing off and having, for example, a ground potential to the control signal input terminal 31, the PIN diode 34 is turned off, and each of the parasitic elements 12*a*, 12*b*, 12*c*, and 12*d* does not operate as a parasitic element. Namely, the PIN diodes 34 operate as a plurality of switch means for changing over whether or not to ground the parasitic elements 12*a*, 12*b*, 12*c*, and 12*d*, respectively.

FIGS. 5 to 20 are diagrams of radiation pattern characteristics in an XY plane, showing simulation results of the variable directivity antenna apparatus 21 of FIGS. 1A and 1B when each of the parasitic element 12*a* to 12*d* is turned on or off. As apparent from FIGS. 5 to 20, by turning on or off each of the control signals corresponding to the four parasitic elements 12*a* to 12*d*, respectively, it is possible to form a total of 16 ($=2^4$) directional patterns by the variable directivity antenna apparatus 21. Therefore, it is possible to change the radiation pattern of the wireless signal radiated from the variable directivity antenna apparatus 21, and it is possible to orient a main beam direction to a desired direction. In particular, when the parasitic elements 12*b*, 12*c*, and 12*d* are turned on, respectively, directivities of radiation from the antenna apparatus 21 are oriented to directions different from one another. Therefore, interference among the antenna elements is reduced, and a correlation value becomes smaller.

The wireless communication apparatus 20 including the variable directivity antenna apparatus 21, and configured as described above can solve the following two problems.

First of all, even when the fading occurs in a band due to the reflected waves from the walls and the ceiling, it is possible to hold more effective MIMO wireless communication, by configuring so that one of the two antenna elements (two antenna elements selected from among the antenna elements 11*a*, 11*b*, and 11*c*) receives a direct wave, and so that another antenna element receives a reflected wave having a longer delay time.

Secondly, it is possible to adjust an intensity of a signal inputted to the wireless receiver circuit of each of the wireless transceiver circuits 22*a* to 22*c* to some extent. Generally speaking, the wireless receiver circuit should lead in a signal using AGC (Auto Gain Control) at a preamble part of a packet. Therefore, in the wireless communication apparatus that receives signals simultaneously in a manner such as the MIMO communication method, it is difficult to execute the AGC on each of the wireless receiver circuits individually. In order to prevent signal saturation, the gain should be adjusted according to the largest signal level. For this reason, it is difficult to secure a signal having a small intensity in an environment in which received levels are different from each other greatly. In the present preferred embodiment, it is possible to adjust the intensities of signals to a uniform intensity to some extent by changing over directional patterns of the antenna apparatus. Therefore, even in the environment in which the received levels are greatly different from each other, the present preferred embodiment can exhibit the same advantageous effects. In addition, for this AGC problem, not only in the MIMO wireless communication apparatus, but also in a wireless communication apparatus receiving a plurality of wireless signals simultaneously such as a wireless communication apparatus performing the MRC (Maximum Ratio Combination) processing as described above, the advantageous effects similar to above can be exhibited.

Further, the other advantageous effects of the present preferred embodiment are as follows. The number of feeding paths to each of the antenna elements 11*a* to 11*c* is one per antenna element. Therefore, as compared with the selection diversity method of changing over antenna elements while preparing a plurality of antenna elements, the number of feeding paths can be reduced even when the antenna elements are connected to a wireless apparatus using a coaxial cable or a high frequency connector. The wireless communication apparatus 20 exhibits such an advantageous effect that it can be manufactured with a low cost.

Second Preferred Embodiment

FIG. 21 is a plan view showing a configuration of a variable directivity antenna apparatus 21A according to a second preferred embodiment of the present invention. In the variable directivity antenna apparatus according to the present preferred embodiment, four parasitic elements 70, 71, 72, 73, and 74, and antenna elements 61, 62, 63, and 64 are provided on the dielectric substrate 10 having the back surface on which the ground conductor 13 is formed. The parasitic elements 71, 72, 73, and 74 are located at vertexes of a square, respectively, where the square has a center at which the parasitic element 70 is located. The antenna elements 61, 62, 63, and 64 are located at midpoints of pairs of adjacent parasitic elements (midpoints of respective sides of the square), respectively. In this case, a distance between each antenna element and each of the parasitic elements adjacent to the antenna element is set to a distance "d" of a quarter-wavelength, so that the antenna element is electromagnetically coupled to the parasitic elements adjacent to the antenna element. It is to be noted that each of the parasitic elements 70 to 74 includes the control circuit 30 of FIG. 4.

According to the present preferred embodiment configured as described above, it is possible to configure the variable directivity antenna apparatus 21A using the four antenna elements 61 to 64, and the five parasitic elements 70 to 74. The variable directivity antenna apparatus 21A can be configured in a manner similar to that of the wireless communication apparatus according to the first preferred embodiment of FIG. 3 except for the number of circuits connected to the antenna elements 61 to 64 and the number of control signals inputted to the parasitic elements 70 to 74, and can exhibit the action and advantageous effects similar to those according to the first preferred embodiment.

Third Preferred Embodiment

FIG. 22 is a plan view showing a configuration of a variable directivity antenna apparatus 21B according to a third preferred embodiment of the present invention. The configuration of the variable directivity antenna apparatus 21B according to the present preferred embodiment is characterized by eliminating the antenna elements 63 and 64, as compared with that of the variable directivity antenna apparatus 21A of FIG. 21.

According to the present preferred embodiment configured as described above, it is possible to configure the variable directivity antenna apparatus 21B using the two antenna elements 61 and 62, and the five parasitic elements 70 to 74. The variable directivity antenna apparatus 21B can be configured in a manner similar to that of the wireless communication apparatus according to the first preferred embodiment of FIG. 3 except for the number of circuits connected to the antenna elements 61 and 62 and the number of control signals inputted to the parasitic elements 70 to 74, and can exhibit the action and advantageous effects similar to those according to the first preferred embodiment.

Fourth Preferred Embodiment

FIG. 23A is a plan view showing a configuration of a variable directivity antenna apparatus 21C according to a fourth preferred embodiment of the present invention. FIG. 23B is a side view of the variable directivity antenna apparatus 21C of FIG. 23A. The variable directivity antenna apparatus 21C according to the present preferred embodiment includes two antenna elements 11*b* and 11*d* and one parasitic element 12*a*. The antenna elements 11*b* and 11*d* and one parasitic element 12*a* are arranged on a Y-axis. In this case, a distance between the antenna element 11*b* and the parasitic element 12*a*, and a distance between the antenna element 11*d* and the parasitic element 12*a* are set to a distance "d" of a quarter-wavelength, respectively. In addition, the parasitic element 12*a* includes the control circuit 30 of FIG. 4.

According to the present preferred embodiment configured as described above, it is possible to configure the variable directivity antenna apparatus 21C using the two antenna elements 11*b* and 11*d*, and one parasitic element 12*a*. The variable directivity antenna apparatus 21C can be configured in a manner similar to that of the wireless communication apparatus according to the first preferred embodiment of FIG. 3 except for the number of circuits connected to the antenna elements 11*b* and 11*d* and the number of control signals inputted to the parasitic element 12*a*, and can exhibit the action and advantageous effects similar to those according to the first preferred embodiment.

Fifth Preferred Embodiment

FIG. 24A is a plan view showing a configuration of a variable directivity antenna apparatus 21D according to a fifth preferred embodiment of the present invention. FIG. 24B is a side view of the variable directivity antenna apparatus 21D of FIG. 24A. The configuration of the variable directivity antenna apparatus 21D according to the present embodiment is characterized by eliminating the antenna element 11*b* and the parasitic elements 12*b* and 12*c*, as compared with that of the variable directivity antenna apparatus 21 of FIG. 1A.

According to the present preferred embodiment configured as described above, it is possible to configure the variable directivity antenna apparatus 21D using the two antenna elements 11*a* and 11*c*, and the two parasitic elements 12*a* and 12*d*. The variable directivity antenna apparatus 21D can be configured in a manner similar to that of the wireless communication apparatus according to the first preferred embodiment of FIG. 3 except for the number of circuits connected to the antenna elements 11*a* and 11*c* and the number of control signals inputted to the parasitic elements 12*a* and 12*d*, and can exhibit the action and advantageous effects similar to those according to the first preferred embodiment.

Industrial Applicability

As described above in detail, in the variable directivity antenna apparatus according to the present invention, the distance between each antenna element and each parasitic element is set so that the antenna element is electromagnetically coupled to the parasitic element. The variable directivity antenna apparatus includes the controller means for changing a radiation pattern from the variable directivity antenna apparatus by outputting a control signal for turning on or off the first switch means to change over whether or not the first parasitic element operates as a parasitic element. Therefore, it is possible to selectively change radiation pattern from the variable directivity antenna apparatus, and orient a main beam of the radiation pattern to a desired direction. Due to this configuration, it is possible to greatly shorten the inter-element distance in the environment in which the fading tends to occur because of many reflected waves, and this leads to the variable directivity antenna apparatus which has a small size and can improve a transmission quality of the MIMO wireless method. In particular, the present invention is applicable to a home electric product such as a wireless communication apparatus using an antenna apparatus employing the MIMO wireless communication method, and to any other industrial apparatus.

Reference Signs List

10 dielectric substrate,
11*a*, 11*b*, 11*c* and 11*d* antenna element,
12*a*, 12*b*, 12*c* and 12*d* parasitic element,
13 ground conductor,
14 support member,
20 wireless communication apparatus,
21, 21A, 21B, 21C and 21D variable directivity antenna apparatus,
22*a*, 22*b* and 22*c* wireless transceiver circuit,
23 MIMO modulator and demodulator circuit,
24 baseband signal processing circuit,
25 controller,
26 MAC circuit,
30 control circuit,
31 control signal input terminal,
32 high frequency blocking inductor,
33 impedance matching capacitor,
34 PIN diode,
35 inductor,
36 connection point,
61, 62, 63 and 64 antenna element, and
71, 72, 73 and 74 parasitic element.

The invention claimed is:

1. A variable directivity antenna apparatus comprising:

four parasitic elements including first, second, third and fourth parasitic elements;

three antenna elements each provided in proximity to three parasitic elements of the four parasitic elements so as to be electromagnetically coupled to the three parasitic elements; and four switches connected to the four parasitic elements, respectively, each switch being switchable to change whether or not its respective parasitic element is connected to ground, wherein the three antenna elements and the first to third parasitic elements are located in a regular hexagon pattern such that each of the three antenna elements and each of the first to third parasitic elements are alternately located substantially at respective vertexes of the hexagon pattern, wherein the fourth parasitic element is located substantially at a center of the hexagon pattern, wherein the variable directivity antenna apparatus further comprises a controller for changing a radiation pattern from the variable directivity antenna apparatus by outputting four control signals for turning on or off the four switches, respectively, to change whether or not the four parasitic elements, respectively, operate as reflectors.

2. The variable directivity antenna apparatus as claimed in claim 1, wherein each of the antenna elements is provided to be away from each of the parasitic elements adjacent thereto by an electrical length of a quarter-wavelength.

3. The variable directivity antenna apparatus as claimed in claim 1, wherein each of the switches is a PIN diode connected between each of the parasitic elements, respectively, and a ground conductor.

4. The variable directivity antenna apparatus as claimed in claim 1, wherein each of the antenna elements is provided to be away from each of the parasitic elements adjacent to each of the antenna elements by an electrical length of a quarter-wavelength.

5. The variable directivity antenna apparatus as claimed in claim 1, wherein each of the switches is a PIN diode connected between each of the parasitic elements and a ground conductor.

6. A variable directivity antenna apparatus comprising:

four parasitic elements including first, second, third and fourth parasitic elements;

three antenna elements each provided in proximity to the three parasitic elements which are selected from the four parasitic elements to be adjacent to each of the antenna elements so as to be electromagnetically coupled to the three parasitic elements thereof; and four switches connected to the four parasitic elements, respectively, each changing over whether or not to ground the connected parasitic element, wherein the three antenna elements and the first to third parasitic elements are located substantially at vertexes of a regular hexagon, respectively, so that each of the three antenna elements and each of the first to third parasitic elements are alternately located, wherein the fourth parasitic element is located substantially at a center of the regular hexagon, wherein variable directivity antenna apparatus further comprises a controller for changing a radiation pattern from the variable directivity antenna apparatus by outputting four control signals for turning on or off the four switches to change over whether or not the four parasitic elements operate as reflectors, respectively.

* * * * *